United States Patent [19]

Shotbolt

[11] 4,391,331

[45] Jul. 5, 1983

[54] GUIDES FOR USE IN FORMING PIPE CONNECTIONS AND A PROCESS OF FORMING PIPE CONNECTIONS

[75] Inventor: Keith Shotbolt, Gerrards Cross, England

[73] Assignee: Constructors John Brown Limited, London, England

[21] Appl. No.: 176,293

[22] Filed: Aug. 8, 1980

[30] Foreign Application Priority Data

Aug. 10, 1979 [GB] United Kingdom ..... 7928006

[51] Int. Cl.[3] ..... E21B 7/128

[52] U.S. Cl. ..... 166/342; 166/349; 285/DIG. 21; 285/24

[58] Field of Search ..... 285/DIG. 21, 18, 24, 285/27, 39; 166/77.5, 341-343, 349, 237; 175/10; 173/164; 294/86.24, 86.25, 86.12; 81/444, 445, 459

[56] References Cited

U.S. PATENT DOCUMENTS

| | | | |
|---|---|---|---|
| 3,163,228 | 12/1960 | Hayes | 285/Dig. 21 |
| 3,380,528 | 4/1968 | Timmons | 294/86.25 |
| 3,851,714 | 12/1974 | Visser et al. | 173/164 |
| 3,987,741 | 10/1976 | Tryon | 285/DIG. 21 |

*Primary Examiner*—William F. Pate, III

*Attorney, Agent, or Firm*—Bacon & Thomas

[57] ABSTRACT

A guide is provided for forming a pipe connection from a sub sea wellhead back to a surface platform which may not be in perfect alignment. The guide comprises a guide post and a cable on which it may be lowered through a pipe to the wellhead. The guide post has a radially expandable mandrel for temporary rigid attachment in the wellhead and an elongate portion having a rotatable sleeve over which the pipe may be lowered into engagement with the wellhead and rotation to form the connection desired. The rotation of the pipe to form the connection is possible because of the sleeve.

8 Claims, 3 Drawing Figures

GUIDES FOR USE IN FORMING PIPE CONNECTIONS AND A PROCESS OF FORMING PIPE CONNECTIONS

BACKGROUND OF THE INVENTION

The present invention relates to guides to assist connection of a pipe, e.g. a conductor pipe, lowered from a platform over the surface of the sea, to a wellhead positioned on the sea bed and to processes of connection employing such guides.

Offshore oil and gas fields have been developed using large platforms, which were constructed and installed offshore before drilling began. This meant that production rate would increase gradually as each well was drilled and completed.

In order to reduce the time taken to produce hydrcarbons at a significant rate, it is possible to drill wells using mobile drilling rig during the period required to construct the production platform. When the platform has been accurately installed over the "pre-drilled" wells, conductor pipes are lowered through guides to connect to the seabed wellheads. These pipes effectively lengthen the well bores above water level, so that the wellheads can be positioned at platform deck level. This permits tubing to be installed from the deck, and wellhead valves which form the "Christmas tree" can be manually actuated by an operator on the platform. These pipes are known as "tie-back" conductor pipes.

As offshore fields progress to deeper water, mobile rigs have been developed from being bottom supported, or "jack-up" type, to floating rigs which are either shipshape or semi-submersible. Floating rigs are less easily maintained directly over a point on the sea bed than jack-up rigs, as they tend to drift laterally against their anchor chains or their dynamic positioning reference beacon.

Drilling from a jack-up rig involves the use of a conductor pipe extending from the sea bed to the deck level where a safety system or "blow-out-preventor (BOP) is mounted on top of the conductor. The BOP is used to control the well in the event that the drill bit pierces a formation containing pressurised oil or gas which is at a higher pressure than that exerted by the head of drilling mud in the hole. With a floating rig the lateral motion of the vessel is accommodated by a flexing "riser" incorporating an articulated joint at the lower end.

Because the articulated joint is relatively poor at retaining high pressure oil and gas, the BOP is mounted on a sea bed wellhead.

This difference in drilling method means that the vertical misalignment tolerance of the wellbore immediately below the seabed is wider for wells drilled from a floating rig than those drilled from a jack-up rig. Also in deeper water, the fixed platform structure tends to an increasing height to base-width ratio, and therefore vertically becomes less controllable. If "pre-drilling" is to be successfully applied in deeper water, the connection system between the conductor pipes and the sub sea wellheads must be able to accept a wider angular misalignment tolerance between guide funnels in the platform structure and the sub sea wellbores.

DESCRIPTION OF THE PRIOR ART

The present Applicant has previously proposed (Offshore Services—May 1979) an apparatus for forming an underwater connection which comprised a guide post having at one end an expandable mandrel. In use, the mandrel was to be locked into a wellhead and a pipe was to be slid down a cable tensioned between the surface and the free end of the guide post so that the pipe would pass over the post and be aligned for engagement with the wellhead. It has now however been appreciated that the misalignment between the pipe and the wellhead corrected by the post would result in many cases in so much frictional engagement between the post and the pipe that it would not be possible to turn the pipe to effect a connection to the wellhead in the case where the connecting means is such as to require rotation e.g. a screw thread.

BRIEF DESCRIPTION OF THE INVENTION

It is desired therefore to provide means first to guide the end of the conductor pipe to a position directly above the sub sea wellhead, then to apply a bending moment to the lower end of the conductor pipe if needed, to bring its axis into coincidence with the wellhead axis, and finally to permit free rotation of the conductor pipe, if necessary, while in the bent configuration, to effect a connection, e.g. a threaded or other rigid connection to the wellhead.

Accordingly, the present invention provides a guide for use in connecting a pipe 6 to a sub sea wellhead 3, which guide comprises a guide post 1 having a reversibly radially expandable portion 2 to locate in and rigidly attach the guide post to the sub sea wellhead, and an elongate portion 1A to be received in the end of the pipe, characterised in that the elongate portion comprises means 12 rotatable about the axis of the post for supporting the pipe for rotation to connect to the wellhead.

In use, the guide post will normally be suspended on suitable means for lowering it from the sea surface, e.g. a cable or hollow pipe, usually attached on the axis of the guide post and preferably providing a hydraulic connection to the guide post when the expandable portion is hydraulically actuated.

The expandable portion may be an expanding mandrel and the expanding mandrel will preferably be wholly or partially segmented and co-operate with wedging surfaces so that as the segments move over the wedging surfaces, the outside diameter either increases or decreases, depending on the direction of motion.

To enable the expanding mandrel to be actuated in a remote location, the actuating means will preferably be hydraulic, and able to cause expansion or contraction of the mandrel.

The elongate portion of the guide post preferably comprises a rotatable sleeve which may be supported on the post on low-friction bearings to provide the said means for supporting the pipe for rotation.

The invention includes a process for connecting a pipe 6 to a sub sea wellhead 3 to which it is connectable which process comprises suspending the pipe 6 above the wellhead 3, lowering through the bore of the pipe a guide comprising guide post 1 and means 4 for lowering the guide post 1, the guide post 1 having a reversibly radially expandable portion 2 and an elongate portion 1A.

BRIEF DESCRIPTION OF THE DRAWINGS

In order that the present invention may be more readily understood, the following description of a specific example is given for illustration, reference being made to the accompanying drawings wherein.

DETAILED DESCRIPTION OF THE INVENTION

Figure 1:
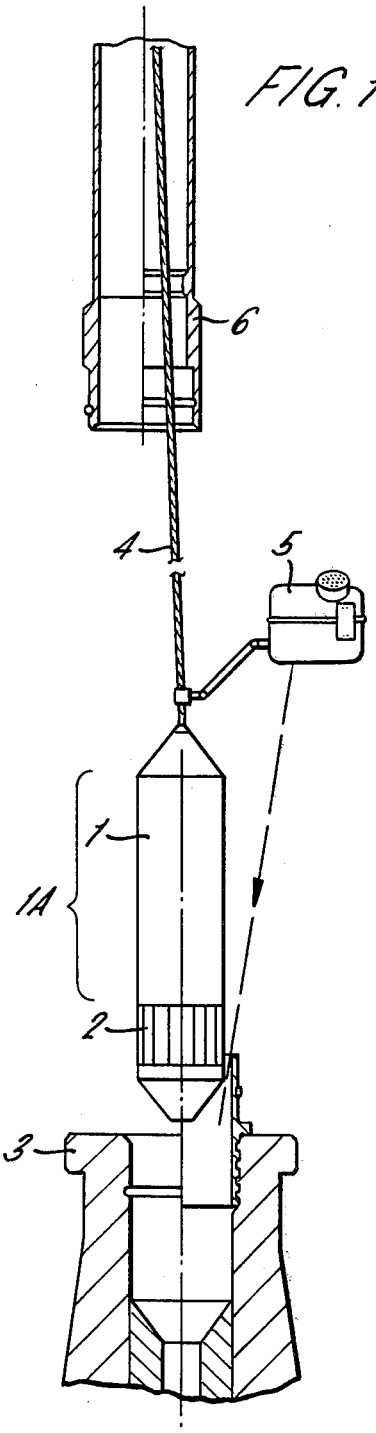
FIG. 1 is a view showing a guide post being positioned over the wellhead.
Figure 3:
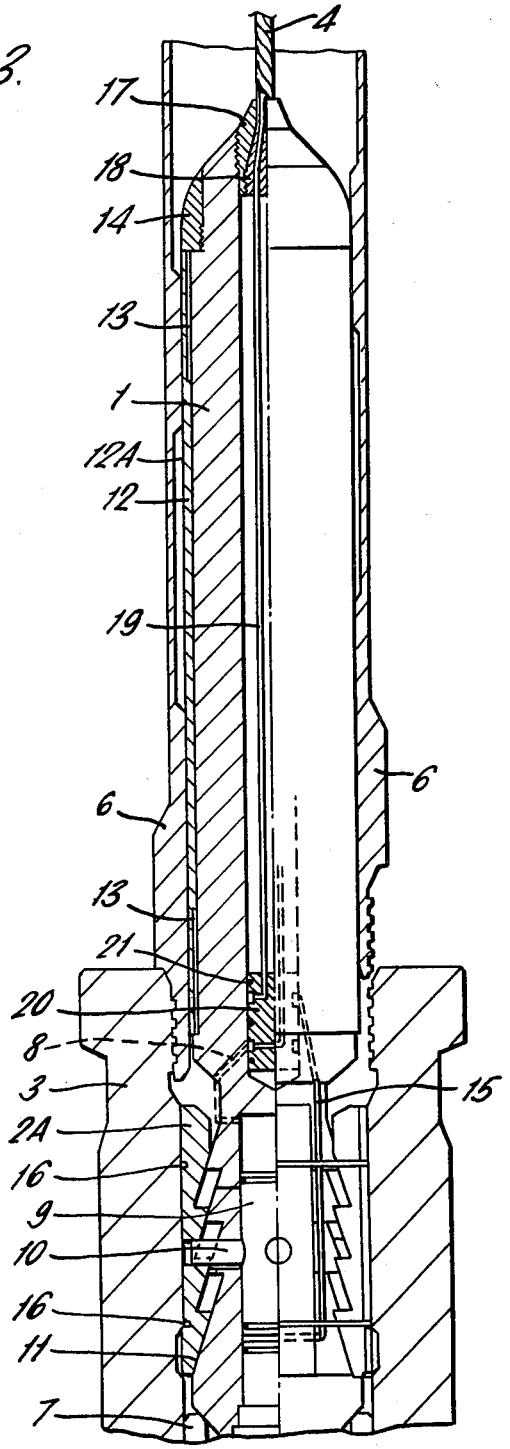
FIG. 3 is a half-sectional view showing the guide post of FIG. 1 latched into the wellhead, with the conductor pipe lowered over the post.

As shown in FIG. 1 the guide according to the invention includes a guide post 1 having toward one end an expanding mandrel 2, each end of the post 1 being frusto conical to aid location in the wellhead and pipe as described hereafter. As shown in FIG. 3, the post 1 bears, above the expanding mandrel 2 a sleeve 12 having an exterior surface 12A. Sleeve 12 is rotatable on bearings 13. The body of the post 1 under the sleeve 12 is recessed so that the outer surface 12A of the sleeve lies flush with or slightly raised above the adjacent parts of the post. A bearing 13 is provided at each end of the sleeve and may be a plain bearing or a roller, e.g. a tapered roller, bearing. A shaped nut 14 maintains the sleeve 12 in position on the post.

The post 1 is hollow allowing a pair of hydraulic lines 19 (one shown in ghost lines) connecting a hydraulic line containing cable 4 on which the guide post is suspended to a distribution block 20 which provides connection to two hydraulic lines 8 and 15 serving the expanding mandrel 12.

Cable 4 is attached by a gland 17 to the top of post 1. The internal gland nut 18 acts to grip reinforcing armour wires around the cable 4. Sealing between the block 20 and the bore of post 1 is effected typically by resilient seal 21.

In place of cable 4 it would also be possible to employ a pipe as the means for lowering the guide post. Such a pipe would normally be composed of many threaded sections assembled onto one another as the guide is lowered.

Expanding mandrel 2 includes a set of segments 2A movable radially outward and inward in response to the motion of a hydraulic piston 9 located in a cylinder on the axis of the post and bearing pins 10, which each engage a segment 2A and drive their segment 2A up and down over a set of wedge surfaces 11 so that downward motion of the piston 9 upon introduction of fluid into the cylinder above the piston via line 8 expands the mandrel. The segments are held against the wedge surfaces by sprung bands 16. Line 15 communicates between the distribution block 20 and the cylinder below piston 9. The mandrel is shown in FIG. 3 in the expanded position.

The ratio length of the rotatable portion of the guide post to its diameter is generally preferably about 3:1 but may be less e.g. 2:1. The length necessary to enable a sufficient moment to be applied to the pipe to bend it into alignment will depend on the operating circumstances and the material of which the pipe is constructed.

The tolerance in angular alignment of the tie back conductor to wellhead to which conventional drilling equipment operates is about 1.5°. The present invention as specifically described enables an angular misalignment of 1.5° to be corrected and may allow greater misalignments, e.g. of up to 2.5°, to be corrected.

The operation of the apparatus shown in the drawings is as follows:

As shown in FIG. 1, the guide post 1 is lowered on its own cable 4 through the inside of the conductor pipe until it is about 2 ft. above the wellhead. A diver or Remotely Controlled Vehicle (RCV) 5 with television and manipulator then positions the post directly over the wellhead, and it is lowered the remaining few feet into a latching position inside the wellhead 3 with the major portion of the post protruding about 6 ft. The expanding mandrel 2 at the lower end of the guide post can be actuated hydraulically to rigidly clamp the post to the wellhead bore.

By pressurising the hydraulic line 8 which extends from cable 4, the piston 9 is driven downwards and pins 10 push the mandrel segments 2 to expand against the inside bore of the wellhead 3 by moving along wedge surfaces 11.

Figure 2:
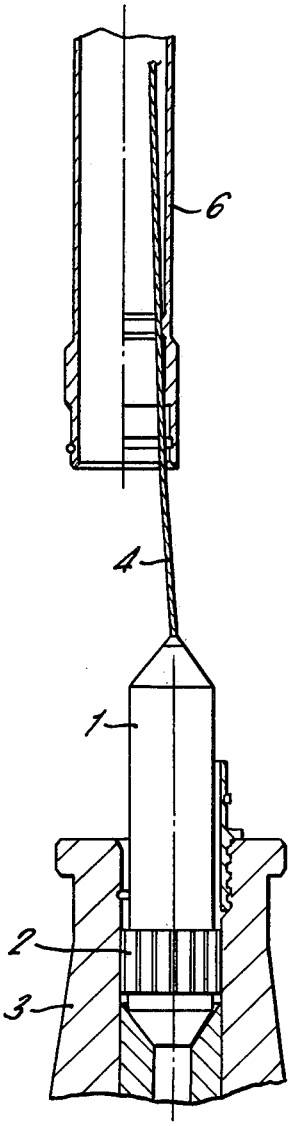
FIG. 2 is a view showing the guide post of FIG. 1. latched into the wellhead prior to lowering the conductor.

When the lower end of the post is fixed into the wellhead as shown in FIG. 2, the cable is tensioned by pulling at the platform deck. The conductor 6 is lowered the remaining distance to the wellhead, and is guided laterally by the cable to the top of the post which has a conical shape to assist the lower end of the conductor on its way down over the major portion of the post. As the conductor closely approaches the wellhead, the conductor bore has a close sliding fit over the sleeve 12 which extends over the outside of the major portion of the post. The combination of the weight of the conductor and two spaced points of contacts between the conductor and the sleeve is able to supply a bending moment to the conductor to eliminate most of any initial angular misalignment.

The pipe and wellhead have co-operating connecting means which are connectable by rotation of the pipe. On the right hand side of FIGS. 1 and 2 the connecting means are shown as scree threaded portions. On the left hand side of FIGS. 1 and 2 an alternative possibility is schematically shown, namely a latch mechanism actuated by rotation.

On the right hand side of FIG. 3, the lower threaded end of conductor pipe 6 is shown about to enter the mating threaded portion of the wellhead 3.

Rotation of the conductor pipe 6 in the correct sense causes the threaded end of pipe 6 to enter the mating thread at the top of wellhead 3. As this rotation proceeds, the two spaced locations along the sleeve 12 support lateral loads to maintain close axial alignment between the conductor 6 and the wellhead 3. If the post had no sleeve 12 with low-friction bearings 13, there would be a scuffing or galling action between the inside surface of pipe 6 and the outside surface of post 2. With the sleeve 12 and bearings 13 in place, the conductor pipe 6 can rotate freely round the post even though there may be a lateral force and a considerable bending moment action between the conductor pipe 6 and the post 1. The position then reached is shown on the left side of FIG. 3.

When the conductor pipe 6 is fully screwed into the wellhead 3, the post 1 can be released. This is done by pressurising the second hydraulic line 15 which pushes the piston 9 upwards to raise the mandrel segments 2A.

The wellhead may have an extension piece rigidly attached above it, which piece may have a threaded or other type of profile for effecting a connection to the tie-back conductor. The guide post may be adapted to locate into the wellbore extension piece, rather than into the wellhead itself.

The apparatus is useful in a situation where sub sea wells have been drilled through a seabed template and a platform structure has been positioned over them. A conductor usually consisting of 40 ft. long lengths of pipe which are joined in the vertical position and progressively lowered through guide funnels in the structure, is supported 30 to 50 ft. above the mating wellhead.

The connector between the conductor and wellhead will generally require conductor rotation to permit makeup. It may be a direct threaded type connection; or may require rotation to clamp a lock ring, e.g. the Koomey Triple—S System. In the illustrated embodiment the sleeve over the major portion of the post is mounted on low-friction bearings, so that when torque is applied to the conductor at platform deck level, the two parts of the connector are held in axial alignment and the bending moment is supported by the bearings. This eliminates the possibilities of (a) cross threading the connector, and (b) scuffing or galling the mating surfaces of the two parts of the connector.

After connection has been made, the expanding mandrel can be released and the post can be recovered by pulling it up through the conductor.

Although the invention has been described with reference to forming a connection to a sub sea wellhead, it will be appreciated that the invention is also applicable to other situations where a pipe is to be connected to an open hollow structure, particularly where angular misalignment may be encountered. Accordingly, the invention includes a guide for use in connecting a pipe to an open hollow structure by a joint formed upon rotation of the pipe or the structure and comprising a guide post having a radially expandable portion to locate in and rigidly attach the guide post to the hollow structure, and an elongate portion providing means rotatable about the axis of the post and to be received in the end of the pipe to support the pipe for rotation relative to the hollow structure.

I claim:

1. A guide for use in connecting a pipe to a connector of a sub sea wellhead, which guide comprises a guide post having a reversibly radially expandable portion to locate in and rigidly attach the guide post to the sub sea wellhead, and an elongate portion to be received in the pipe wherein the elongate portion comprises an elongate sleeve freely rotatable about the axis of the post for supporting the pipe for rotation to connect to the wellhead and suitable to constrain the pipe to an orientation in which it is concentric and coaxial with the wellhead connector.

2. A guide as claimed in claim 1 wherein the expandable portion of the guide post is divided into segments, wedging surfaces are provided on the post with which the segments co-operate, the segments and means are provided to cause the segments to move over the wedging surfaces, the segments being thereby forced radially outward or permitted to move radially inward.

3. A guide as claimed in claim 1 wherein the elongate sleeve extends over substantially the whole length of the elongate portion.

4. A guide as claimed in claim 1 wherein the guide comprises means for lowering the guide post from the sea surface to the wellhead.

5. A guide as claimed in claim 4 wherein the lowering means is a hydraulic cable or a pipe.

6. A process for connecting a pipe to a sub sea wellhead to which it is connectable upon rotation, which process comprises suspending the pipe above the wellhead, lowering through the bore of the pipe a guide comprising a guide post and means for lowering the guide post, the guide post having a reversibly radially expandable portion locating the radially expandable portion into the wellhead and radially expanding that portion to rigidly attach the guide to the wellhead, lowering the pipe over the elongate portion of the guide into position for connection to the wellhead connecting the pipe to the wellhead by rotation of the pipe, radially contracting the expandable portion of the guide and withdrawing the guide through the pipe, wherein the elongate portion of the guide post comprises means rotatable about the axis of the post for supporting the pipe for rotation to connect to the wellhead.

7. A guide for use in connecting a pipe to an open hollow structure by a joint formed upon rotation of the pipe relative to the structure and comprising a guide post having a radially expandable portion to locate in and rigidly attach the guide post to the hollow structure, and an elongate portion to be received in the end of the pipe wherein the elongate portion provides an elongate sleeve freely rotatable about the axis of the post and suitable to constrain the pipe to be concentric with and coaxial with the guide post and for supporting the pipe for rotation relative to the hollow structure.

8. A guide for use in connecting a pipe to a sub sea wellhead, which guide comprises a guide post having a reversibly radially expandable portion to locate in and rigidly attach the guide post to the sub sea wellhead; hydraulic means to expand and contract the expandable portion; and an elongate portion to be received in the pipe, wherein the elongate portion comprises means rotatable about the axis of the post for supporting the pipe for rotation to connect to the wellhead.

* * * * *